US011474456B1

(12) United States Patent
Yasuda et al.

(10) Patent No.: US 11,474,456 B1
(45) Date of Patent: Oct. 18, 2022

(54) IMAGE FORMING APPARATUS

(71) Applicant: FUJIFILM Business Innovation Corp., Tokyo (JP)

(72) Inventors: Takeshi Yasuda, Ebina (JP); Daisuke Tanaka, Ebina (JP); Kaoru Matsushita, Ebina (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/409,995

(22) Filed: Aug. 24, 2021

(30) Foreign Application Priority Data

Mar. 26, 2021 (JP) ..... JP2021-054179

(51) Int. Cl.
*G03G 15/16* (2006.01)

(52) U.S. Cl.
CPC ..... *G03G 15/161* (2013.01)

(58) Field of Classification Search
CPC ..... G03G 15/161
See application file for complete search history.

(56) References Cited

U.S. PATENT DOCUMENTS 4,172,303 A * 10/1979 Wooding ..... G03G 21/0035 399/349
2005/0207779 A1* 9/2005 Takahashi ..... G03G 15/168 399/101
2011/0142485 A1 6/2011 Ishikawa et al.
2013/0243473 A1* 9/2013 Noguchi ..... G03G 15/0131 399/101

FOREIGN PATENT DOCUMENTS

JP 56135865 A 10/1981
JP 2007140374 A 6/2007
JP 2011-123384 A 6/2011

OTHER PUBLICATIONS

Communication dated Feb. 16, 2022 issued by the European Patent Office in application No. 21195686.7.

* cited by examiner

*Primary Examiner* — Clayton E. LaBalle
*Assistant Examiner* — Michael A Harrison
(74) *Attorney, Agent, or Firm* — Sughrue Mion, PLLC

(57) ABSTRACT

An image forming apparatus includes: a toner transport body that is an endless belt holding a toner image, or is a transfer member transferring the toner image to a recording medium nipped between the endless belt and the transfer member; a cleaning brush that has plural first bristle materials that rotate and come into contact with a surface of the toner transport body, and cleans a toner adhering to the surface of the toner transport body; and a removing brush that has plural second bristle materials in contact with the first bristle material of the cleaning brush and removes the toner adhering to the first bristle material.

8 Claims, 5 Drawing Sheets

IMAGE FORMING APPARATUS

CROSS-REFERENCE TO RELATED APPLICATIONS

This application is based on and claims priority under 35 USC 119 from Japanese Patent Application No. 2021-054179 filed on Mar. 26, 2021.

BACKGROUND

1. Technical Field

The present invention relates to an image forming apparatus.

2. Related Art

JP-A-2011-123384 discloses an image forming apparatus including: a brush having plural bristle materials that rotate and come into contact with a surface of an image holder; a removing member that is provided at a position in contact with the plural bristle materials, comes into contact with and separates from the plural bristle materials along with rotation of the brush, and elastically deforms the plural bristle materials by contact and leaves the plural bristle materials elastically deformed to restore by separation so as to remove a developer adhering to the plural bristle materials; and a transport device that is provided below the removing member in a direction of gravity and transports the developer removed by the removing member. A space for allowing the developer to fall toward the conveying device is provided between the conveying device and a contact portion where the plural bristle materials and the removing member start to come into contact with each other.

SUMMARY

Aspects of non-limiting embodiments of the present disclosure relate to improving an effect of removing a toner on a cleaning brush as compared with a configuration in which the toner on the cleaning brush is removed by using a removing member having, for example, a round bar shape or a plate shape.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: a toner transport body that is an endless belt holding a toner image, or is a transfer member transferring the toner image to a recording medium nipped between the endless belt and the transfer member; a cleaning brush that has plural first bristle materials that rotate and come into contact with a surface of the toner transport body, and cleans a toner adhering to the surface of the toner transport body; and a removing brush that has plural second bristle materials in contact with the first bristle material of the cleaning brush and removes the toner adhering to the first bristle material.

BRIEF DESCRIPTION OF THE DRAWINGS

Exemplary embodiments of the present disclosure will be described in detail based on the following figures, wherein.

DETAILED DESCRIPTION

Figure 1:
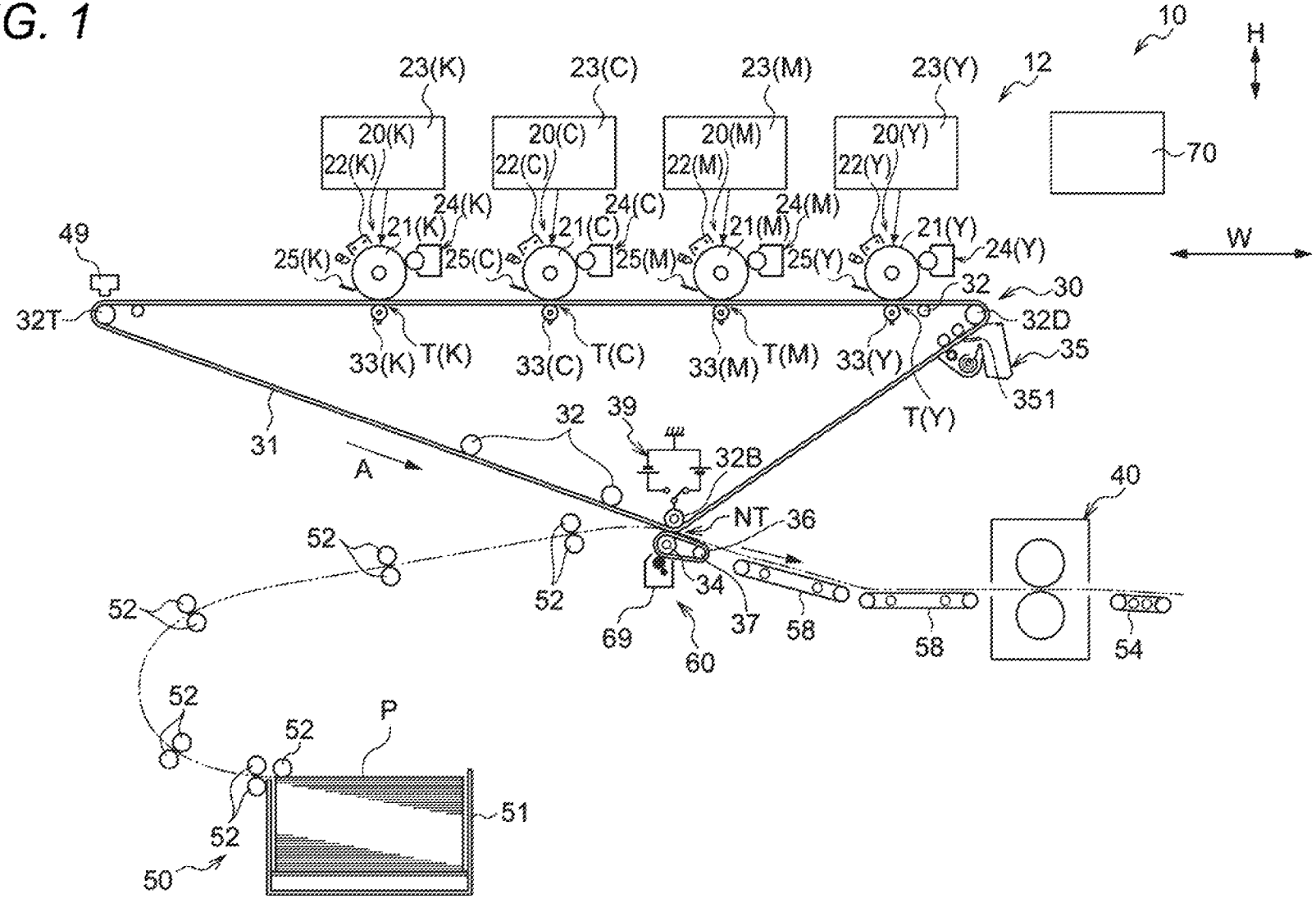
FIG. 1 is a schematic diagram illustrating a configuration of an image forming apparatus according to the present exemplary embodiment as viewed from a front side.

Hereinafter, an example of an exemplary embodiment according to the present invention will be described with reference to the drawings. In the drawings, an arrow H indicates a vertical direction, and an arrow W indicates a horizontal direction and an apparatus width direction.

<Configuration of Image Forming Apparatus 10>

FIG. 1 is a schematic diagram illustrating a configuration of an image forming apparatus 10 as viewed from a front side. As illustrated in FIG. 1, the image forming apparatus 10 includes an image forming unit 12 that forms an image on a recording medium P such as a sheet by an electrophotographic process, a transport device 50 that transports the recording medium P, and a control unit 70 that controls an operation of each unit of the image forming apparatus 10.

(Transport Device 50)

As illustrated in FIG. 1, the transport device 50 includes a container 51 that accommodates the recording medium P, and plural transport rollers 52 that transports the recording medium P from the container 51 to a secondary transfer position NT. The transport device 50 further includes plural transport belts 58 that transport the recording medium P from the secondary transfer position NT to a fixing device 40, and a transport belt 54 that transports the recording medium P from the fixing device 40 to a discharge portion (not illustrated) of the recording medium P.

(Image Forming Unit 12)

The image forming unit 12 includes toner image forming units 20 that form toner images, a transfer device 30 that transfers the toner images formed by the toner image forming units 20 to the recording medium P, and the fixing device 40 that fixes the toner images transferred to the recording medium P to the recording medium P by heating and pressurizing the toner images.

The plural toner image forming units 20 are provided so as to form the toner image for each color. In the present exemplary embodiment, the toner image forming units 20 of a total of four colors of yellow (Y), magenta (M), cyan (C), and black (K) are provided. The toner image forming units 20 of the respective colors are arranged in the order of yellow (Y), magenta (M), cyan (C), and black (K) from an upstream side to a downstream side in a transport direction of an intermediate transfer belt 31 to be described later.

The (Y), (M), (C), and (K) illustrated in FIG. 1 indicate constituent portions corresponding to the respective colors. In the description of the present specification, parentheses of (Y), (M), (C), and (K) may be omitted, and (Y), (M), (C), and (K) may be referred to as Y, M, C, and K.

[Toner Image Forming Unit 20]

Figure 2:
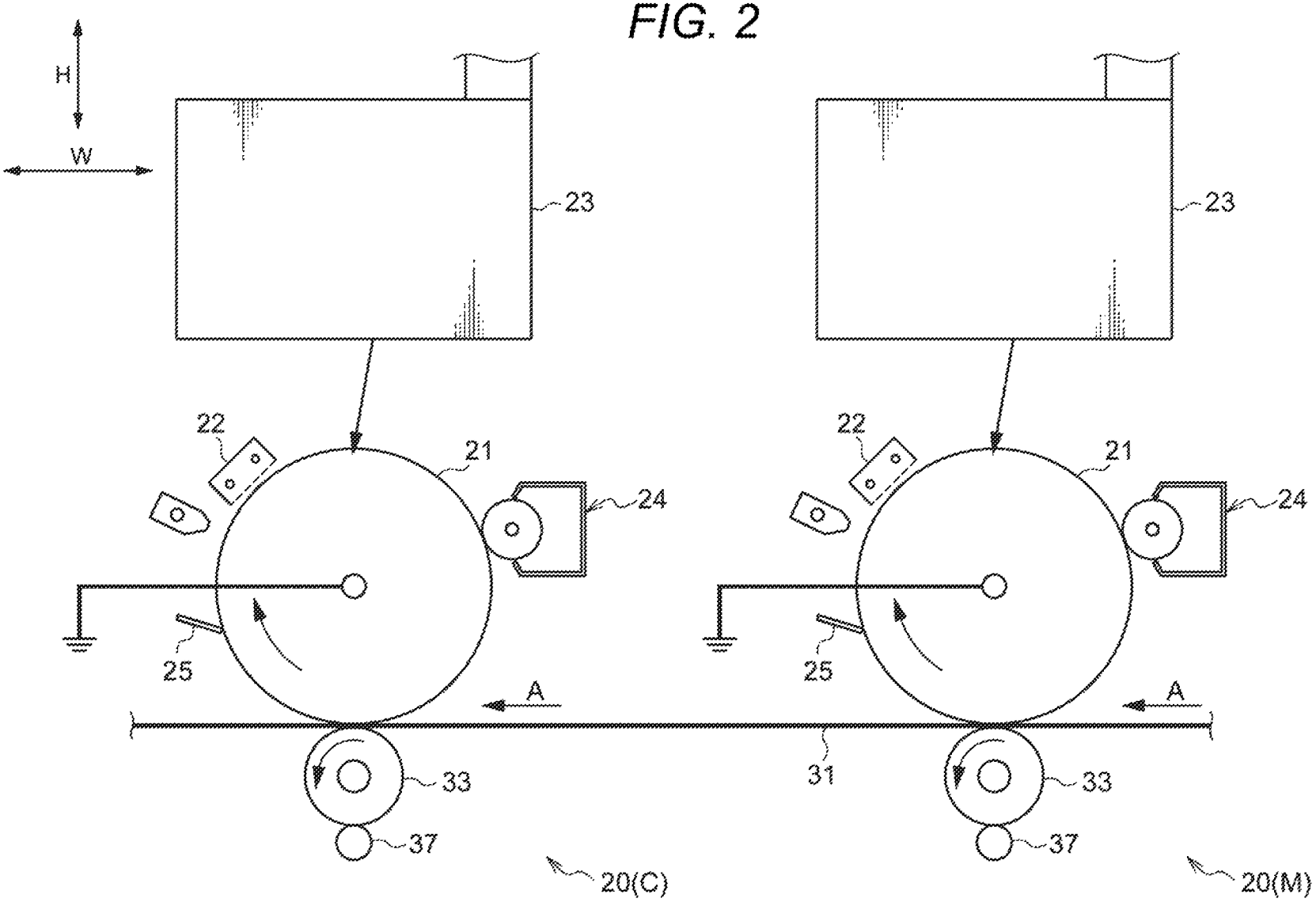
FIG. 2 is a schematic diagram illustrating a toner image forming unit according to the present exemplary embodiment.

The toner image forming units 20 of the respective colors are basically configured in a similar manner except for a toner to be used. Specifically, as illustrated in FIG. 2, the toner image forming unit 20 of each color includes a photoconductor drum 21 that rotates clockwise in FIG. 2, a charging unit 22 that charges the photoconductor drum 21, and an exposure device 23 that exposes the photoconductor drum 21 charged by the charging unit 22 to form an electrostatic latent image on the photoconductor drum 21. The toner image forming unit 20 of each color further includes a developing device 24 that develops the electrostatic latent image formed on the photoconductor drum 21 by the exposure device 23 to form a toner image, and a blade 25 that removes toner remaining on a surface of the photoconductor drum 21 after the toner image is transferred to the transfer device 30.

For example, the charging unit 22 negatively charges the surface (a photosensitive layer) of the photoconductor drum 21. On the surface of the photoconductor drum 21 that is negatively charged, a portion irradiated with an exposure light L by the exposure device 23 has a positive polarity, and the electrostatic latent image is formed on the surface of the photoconductor drum 21. Then, a toner triboelectrically charged to a negative polarity in the developing device 24 adheres to the electrostatic latent image having a positive polarity, and the electrostatic latent image is developed. In this way, the toner image is formed on the surface (an outer circumferential surface) of the photoconductor drum 21. The blade 25 is in contact with the surface of the photoconductor drum 21 and scrapes off the toner remaining on the surface of the photoconductor drum 21.

[Transfer Device 30]

The transfer device 30 primarily transfers the toner images of the photoconductor drums 21 of the respective colors to the intermediate transfer belt 31 in a superimposed manner, and secondarily transfers the superimposed toner images to the recording medium P at the secondary transfer position NT (an example of a nip). Specifically, as illustrated in FIG. 1, the transfer device 30 includes: the intermediate transfer belt 31 as an example of an endless belt and an example of a toner transport body that is a transfer body; primary transfer rollers 33; a secondary transfer belt 36 as an example of a toner transport body that is a transfer body; a cleaning device 60 for the secondary transfer belt 36; and a cleaning device 35 for the intermediate transfer belt 31.

[Intermediate Transfer Belt 31]

As illustrated in FIG. 1, the intermediate transfer belt 31 has an endless shape and is wound around plural rollers 32 to determine a posture thereof. In the present exemplary embodiment, the intermediate transfer belt 31 has an inverted obtuse triangular shape that is long in the apparatus width direction in a front view. Among the plural rollers 32, a roller 32D illustrated in FIG. 1 functions as a driving roller that rotates the intermediate transfer belt 31 in an arrow A direction by the power of a motor (not illustrated). The intermediate transfer belt 31 rotates in the arrow A direction to transport the primarily transferred image to the secondary transfer position NT.

Among the plural rollers 32, a roller 32T illustrated in FIG. 1 functions as a tension applying roller that applies tension to the intermediate transfer belt 31. Among the plural rollers 32, a roller 32B illustrated in FIG. 1 functions as a facing roller of a secondary transfer roller 34. A top portion on a lower end side forming an obtuse angle of the intermediate transfer belt 31 in the posture of the inverted obtuse triangle as described above is wound around the facing roller 32B. The intermediate transfer belt 31 is in contact with the photoconductor drums 21 of the respective colors from below at an upper side portion extending in the apparatus width direction in the above-described posture.

[Primary Transfer Roller 33]

As illustrated in FIG. 1, the primary transfer rollers 33 are rollers that transfer the toner images on the respective photoconductor drums 21 to the intermediate transfer belt 31, and are disposed inside the intermediate transfer belt 31. Each of the primary transfer rollers 33 is disposed to face the photoconductor drum 21 of the corresponding color with the intermediate transfer belt 31 interposed therebetween. Further, a primary transfer voltage having a polarity opposite to a toner polarity is applied to the primary transfer roller 33 by a power supply unit (not illustrated). By the application of the primary transfer voltage, the toner image formed on the photoconductor drum 21 is transferred to the intermediate transfer belt 31 at a primary transfer position T between the photoconductor drum 21 and the primary transfer roller 33.

[Secondary Transfer Belt 36]

Figure 3:
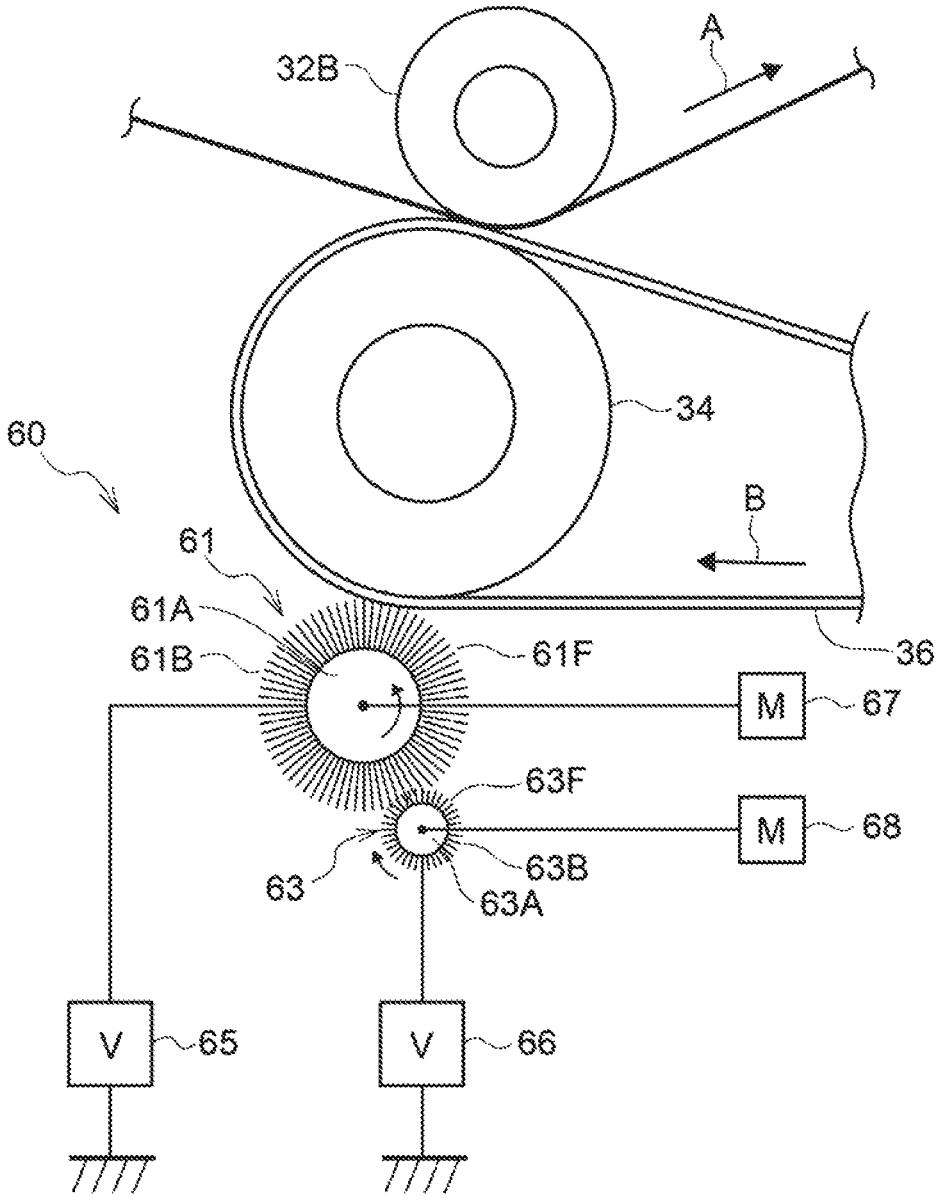
FIG. 3 is a schematic diagram illustrating a transfer device according to the present exemplary embodiment.

The secondary transfer belt 36 is a belt that transfers the toner image superimposed on the intermediate transfer belt 31 to the recording medium P. As illustrated in FIG. 3, the secondary transfer belt 36 has an endless shape and is wound around the secondary transfer roller 34 and a driven roller 37.

The secondary transfer roller 34 is disposed such that the intermediate transfer belt 31 and the secondary transfer belt 36 are interposed between itself and the facing roller 32B, and the secondary transfer belt 36 and the intermediate transfer belt 31 are in contact with each other with a predetermined load. The secondary transfer position NT is defined between the secondary transfer belt 36 and the intermediate transfer belt 31 that are in contact with each other. The recording medium P is supplied from the container 51 to the secondary transfer position NT at an appropriate time. The secondary transfer belt 36 is rotated in an arrow B direction by the secondary transfer roller 34 being rotationally driven.

In the present exemplary embodiment, when the toner image on the intermediate transfer belt 31 is transferred to the recording medium P, a negative voltage is applied to the facing roller 32B by a power supply unit 39. Accordingly, a potential difference is generated between the facing roller 32B and the secondary transfer roller 34. That is, when the negative voltage is applied to the facing roller 32B, a secondary transfer voltage (a positive voltage) having a polarity opposite to the toner polarity is indirectly applied to the secondary transfer roller 34 forming a counter electrode of the facing roller 32B. Accordingly, a negative toner image is transferred from the intermediate transfer belt 31 to the recording medium P passing through the secondary transfer position NT.

On the other hand, in a case where the toner on the intermediate transfer belt 31 is held on the intermediate transfer belt 31 when the toner passes through the secondary transfer position NT, the positive voltage is applied to the facing roller 32B by the power supply unit 39. Accordingly, a potential difference is generated between the facing roller 32B and the secondary transfer roller 34. That is, when the positive voltage is applied to the facing roller 32B, a non-transfer voltage (the negative voltage) having the same polarity as the toner polarity is indirectly applied to the secondary transfer roller 34 forming the counter electrode of the facing roller 32B. Accordingly, the toner passing through the secondary transfer position NT is subjected to a repulsive force from the secondary transfer roller 34 and is held on the intermediate transfer belt 31.

[Cleaning Device 60 of Secondary Transfer Belt 36]

As illustrated in FIG. 3, the cleaning device 60 includes a cleaning brush 61 having a columnar shape that attracts and cleans the toner on the secondary transfer belt 36 by an electrostatic force corresponding to an applied bias voltage. The expression "to clean the toner adhering to the belt" is synonymous with the expression "to remove the toner from the belt".

The cleaning brush 61 includes a shaft portion 61A made of metal and a brush portion 61B made of a synthetic resin and provided on an entire outer periphery of the shaft portion 61A. In the brush portion 61B, plural first bristle materials 61F extend from the shaft portion 61A in a radial direction (a radially outward direction).

The cleaning brush 61 rotates when the shaft portion 61A is driven to rotate by a rotation driving device 67 that includes a motor, a speed reducer, and the like (not illustrated). As an example, the cleaning brush 61 rotates in the same direction as a rotation direction of the secondary transfer belt 36 (a clockwise direction in FIG. 3).

The rotation driving device 67 may also rotate the cleaning brush 61 in a direction opposite to the rotation direction of the secondary transfer belt 36 (a counterclockwise direction in FIG. 3). When the cleaning brush 61 rotates in the direction opposite to the rotation direction of the secondary transfer belt 36, for example, the cleaning brush 61 rotates with a circumferential speed difference with respect to a circumferential speed of the secondary transfer belt 36.

Further, the cleaning device 60 includes a removing brush 63 that is in contact with the brush portion 61B of the cleaning brush 61 and is formed in, for example, a columnar shape.

The removing brush 63 includes a shaft portion 63A made of metal and a brush portion 63B made of synthetic resin and provided on an entire outer periphery of the shaft portion 63A. The brush portion 63B is provided with plural second bristle materials 63F. In the brush portion 63B of the present exemplary embodiment, the second bristle materials 63F having the same length extend from the shaft portion 63A in a radial direction (a radially outward direction).

The removing brush 63 is arranged such that a part of tip ends of the second bristle material 63F enters an inner portion of the brush portion 61B of the cleaning brush 61, and is configured such that the first bristle material 61F is flicked by the second bristle material 63F when the first bristle material 61F of the cleaning brush 61 and the second bristle material 63F of the removing brush 63 move relative to each other.

It is also possible to make a bending rigidity of the second bristle material 63F higher than that of the first hair material 61F so that the first bristle material 61F is more likely to be flicked than in a case where the bending rigidity of the second bristle material 63F is equal to that of the first bristle material 61F. Although the second bristle material 63F is formed to be shorter than the first bristle material 61F in the present exemplary embodiment, a length of the second bristle material 63F may be appropriately changed as necessary. For example, the second bristle materials 63F having different lengths may be mixed.

In addition, a bristling density of the second bristle material 63F in the removing brush 63 may be made higher than that of the first bristle material 61F in the cleaning brush 61. In this way, the second bristle material 63F of the removing brush 63 may be brought into uniform contact with the first bristle material 61F of the cleaning brush 61, and the toner removing effect may be improved.

The removing brush 63 is rotated when the shaft portion 63A is driven to rotate by a second rotation driving device 68 including a motor, a speed reducer, and the like (not shown).

As an example, the removing brush 63 is configured to rotate in the same direction (a clockwise direction in FIG. 3) as a rotation direction of the cleaning brush 61, and the first bristle materials 61F of the cleaning brush 61 and the second bristle materials 63F of the removing brush 63 move in opposite directions at a contact portion of the removing brush 63 and the cleaning brush 61.

The second rotation driving device 68 may also rotate the removing brush 63 in a direction (a counterclockwise direction in FIG. 3) opposite to the rotation direction of the cleaning brush 61. When the removing brush 63 rotates in the direction opposite to the rotation direction of the cleaning brush 61, for example, the removing brush 63 rotates with a circumferential speed difference with respect to a circumferential speed of the cleaning brush 61.

The cleaning device 60 further includes a first power supply unit 65 that applies a positive bias voltage (cleaning voltage) to the shaft portion 61A of the cleaning brush 61, and a second power supply unit 66 that applies a positive bias voltage higher than that of the shaft portion 61A or a negative voltage to the shaft portion 63A of the removing brush 63. The second power supply unit 66 may generate a higher voltage than the first power supply unit 65.

With this configuration, the negatively charged toner on the secondary transfer belt 36 may be electrostatically attracted to the cleaning brush 61. Further, the toner attracted to the cleaning brush 61 may be electrostatically attracted to the removing brush 63.

When a negative voltage is applied to the shaft portion 63A of the removing brush 63, the negative toner moved to the removing brush 63 is subjected to a repulsive electrostatic force. Accordingly, the toner may be removed from the removing brush 63, and the removed toner falls into a receiver 69 (see FIG. 1) disposed below the removing brush 63, for example.

[Cleaning Device 35 for Intermediate Transfer Belt 31]

As illustrated in FIG. 1, the cleaning device 35 is disposed downstream of the secondary transfer position NT and upstream of the primary transfer position T (Y) in a rotation direction of the intermediate transfer belt 31. The cleaning device 35 includes a blade 351 that scrapes off the toner remaining on a surface of the intermediate transfer belt 31 from the surface of the intermediate transfer belt 31.

In the transfer device 30, a detection unit (a sensor) 49 for detecting a density detection image (a patch) and a color shift detection image (a patch) is disposed downstream (a left side in FIG. 1) of the toner image forming unit 20 (K).

The toners of yellow (Y), magenta (M), cyan (C), and black (K) used in the toner image forming units 20Y, 20M, 20C, and 20K (hereinafter, referred to as 20Y to 20K) each include a pigment and a binder resin.

The toner images formed by the toner image forming units 20Y to 20K include a transferred image to be transferred to the recording medium P and a non-transferred image not to be transferred to the recording medium P. Examples of the non-transferred image include a density detection image (a patch), a color shift detection image (a patch), an image (a band) for consuming a deteriorated developer (a toner), and an image (a band) for supplying toner between the photoconductor drum 21 and the blade 25.

Figure 4:
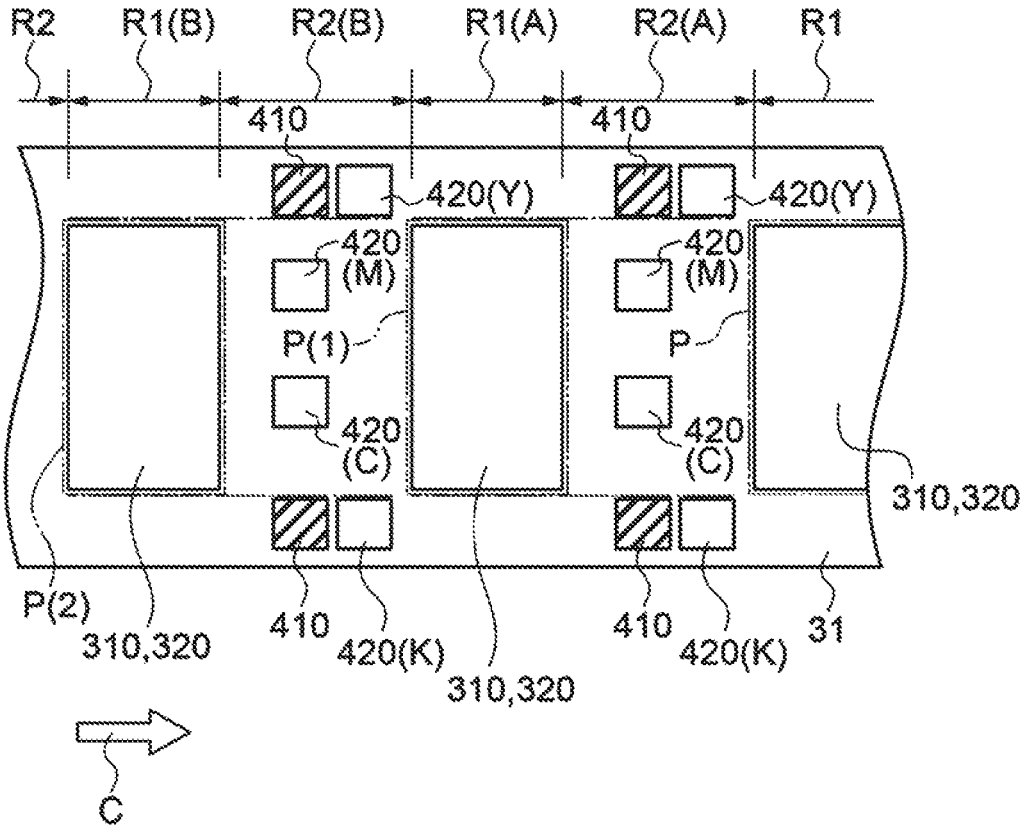
FIG. 4 is a view illustrating a non-transferred image and a transferred image on a transfer belt.

As illustrated in FIG. 4, an image 320 of each toner image forming unit 20 is transferred to transfer regions R1 on the intermediate transfer belt 31 by each primary transfer roller 33. The image 320 transferred to the intermediate transfer belt 31 passes through the secondary transfer position NT together with the recording medium P, and is transferred to the recording medium P.

On the other hand, a patch 420 of each toner image forming unit 20 is transferred to a non-transfer region R2 between the transfer regions R1 by each primary transfer roller 33. The patch 420 transferred to the intermediate transfer belt 31 passes through the secondary transfer position NT alone without passing through the secondary transfer position NT together with the recording medium P.

In the present exemplary embodiment, in a case where the image 320 is transferred from the intermediate transfer belt 31 to the recording medium P, as described above, a positive secondary transfer voltage (a voltage having a polarity opposite to the toner polarity) is applied to the secondary transfer roller 34 via the facing roller 32B. Accordingly, the image 320 passing through the secondary transfer position NT together with the recording medium P is transferred from the intermediate transfer belt 31 to the recording medium P.

On the other hand, when the patch 420 passes through the secondary transfer position NT, the negative non-transfer voltage (a voltage having the same polarity as the toner polarity) is applied to the secondary transfer roller 34 via the facing roller 32B such that the patch 420 on the intermediate transfer belt 31 is held by the intermediate transfer belt 31.

Accordingly, the toner of the patch 420 on the intermediate transfer belt 31 is subjected to a repulsive force from the secondary transfer belt 36 (the secondary transfer roller 34) and is held on the intermediate transfer belt 31. The toner of the patch 420 held on the intermediate transfer belt 31 is transported to the cleaning device 35, and is removed from the intermediate transfer belt 31 by the cleaning device 35.

Here, since the secondary transfer belt 36 and the intermediate transfer belt 31 are in contact with each other with a predetermined load, when the patch 420 is formed on the surface of the intermediate transfer belt 31, a part of the toner of the patch 420 is transferred to the secondary transfer belt 36 even if the toner is subjected to a repulsive electrostatic force.

When the toner of the patch 420 is transferred to the secondary transfer belt 36, the toner adheres to the secondary transfer belt 36 (an example of a transfer member). When the secondary transfer belt 36 rotates, the toner is transported to the cleaning brush 61 and removed by the cleaning brush 61.

Specifically, as described above, when a positive bias voltage is applied to the cleaning brush 61 by the first power supply unit 65, the negative toner transferred to the secondary transfer belt 36 is electrostatically attracted to the cleaning brush 61 and removed from the secondary transfer belt 36.

When a positive bias voltage is applied to the removing brush 63 by the second power supply unit 66, the toner on the cleaning brush 61 is electrostatically attracted to the removing brush 63, and the toner is removed from the cleaning brush 61.

(Operation of Present Exemplary Embodiment)

Next, an operation according to the present exemplary embodiment will be described.

When the control unit 70 receives an image forming command (a print command), the control unit 70 operates the toner image forming units 20Y to 20K, the transfer device 30, and the fixing device 40 as described below (see FIG. 1).

In the toner image forming units 20Y to 20K, the image 320 (see FIG. 4) and the patch 420 (see FIG. 4) are formed in the following image forming steps (processes). That is, the photoconductor drum 21 of each color is charged by the charging unit 22 while being rotated. Each charged photoconductor drum 21 is exposed by each exposure device 23, and the electrostatic latent image is formed on the surface of each photoconductor drum 21. The electrostatic latent image formed on each photoconductor drum 21 is developed by the developer supplied from the developing device 24. Accordingly, the yellow (Y), magenta (M), cyan (C), and black (K) images 320 and patches 420 are formed on the photoconductor drums 21Y to 21K of the respective colors.

As illustrated in FIG. 4, the images 320 of the respective colors formed on the respective photoconductor drums 21 are sequentially transferred to the transfer regions R1 of the rotating intermediate transfer belt 31 by the respective primary transfer rollers 33.

The patches 420 of the respective colors formed on the respective photoconductor drums 21 are sequentially transferred to a random position in the non-transfer regions R2 of the rotating intermediate transfer belt 31 by the respective primary transfer rollers 33.

The image 320 transferred to the intermediate transfer belt 31 is transported to the secondary transfer position NT by the rotation of the intermediate transfer belt 31.

The recording medium P is supplied to the secondary transfer position NT by the transport rollers 52 in accordance with a timing of transporting of the image 320. When the recording medium P and the image 320 (the transfer region R1) pass through the secondary transfer position NT, the secondary transfer voltage (the positive voltage) is applied to the secondary transfer roller 34 via the facing roller 32B. Accordingly, the image 320 is transferred from the intermediate transfer belt 31 to the recording medium P.

The recording medium P to which the image 320 is transferred is transported from the secondary transfer position NT to the fixing device 40 by the transport belts 58, and the image 320 on the recording medium P is fixed to the recording medium P in the fixing device 40.

When the recording medium P does not pass through the secondary transfer position NT and the patch 420 passes through the secondary transfer position NT, the non-transfer voltage (the negative voltage) is applied to the secondary transfer roller 34 via the facing roller 32B. Accordingly, the patch 420 on the intermediate transfer belt 31 is subjected to the repulsive force from the secondary transfer roller 34 (the secondary transfer belt 36) and is held on the intermediate transfer belt 31. Accordingly, the toner of the patch 420 passes through the secondary transfer position NT while being held on the intermediate transfer belt 31, is transported to the cleaning device 35, and is removed from the intermediate transfer belt 31 by the cleaning device 35.

Here, although the non-transfer voltage is applied in this way, since the secondary transfer belt 36 and the intermediate transfer belt 31 are in contact with each other with a predetermined load, a part of the toner of the patch 420 may be transferred to the secondary transfer belt 36 even if the toner is subjected to the repulsive electrostatic force.

In the present exemplary embodiment, the toner that is transferred to the secondary transfer belt 36 is transported to the cleaning device 60 by the rotation of the secondary transfer belt 36. The toner of the image 320 may adhere to the secondary transfer belt 36.

In the cleaning device 60, the first power supply unit 65 applies a first positive voltage to the cleaning brush 61 rotating in a clockwise direction. Accordingly, the negatively charged toner on the secondary transfer belt 36 is electrostatically attracted to the cleaning brush 61 and removed.

Further, in the cleaning device 60, since the removing brush 63 is brought into contact with the rotating cleaning brush 61, it is possible to improve an effect of removing the toner on the cleaning brush 61 as compared with a configuration in which a flicking member that is a metal round bar, or a removing member having, for example, a plate shape is brought into contact with the cleaning brush 61 to remove the toner by flicking the first bristle material 61F. The removing brush 63 not only flicks the first bristle material 61F of the cleaning brush 61 by the second bristle material 63F thereof, but also scrapes out the toner in an inner portion of the brush portion 61B since a tip end portion of the second bristle material 63F enters the inner portion of the brush portion 61B.

Further, in the cleaning device 60 of the present exemplary embodiment, since the removing brush 63 is formed in a columnar shape, the life of the removing brush 63 may be extended as compared with, for example, a case where one portion of a brush provided with plural bristle materials on a plate thereof is brought into contact with the cleaning brush 61.

Further, in the cleaning device 60 of the present exemplary embodiment, since the removing brush 63 is rotated and brought into contact with the cleaning brush 61, a frequency of flicking the first bristle material 61F of the cleaning brush 61 is increased and it is easy to remove the toner from the cleaning brush 61. Since the removing brush 63 is rotated by the second rotation driving device 68, it takes less time and effort than in a case where the removing brush 63 is manually rotated. In addition, by rotating the removing brush 63 of a columnar shape, the entire outer periphery of the brush may be brought into contact with the cleaning brush 61, and the life of the brush portion 63B may be extended as compared with a case where the removing brush 63 is not rotated.

Further, in the present exemplary embodiment, since the removing brush 63 is rotated in the same direction as the cleaning brush 61 and brought into contact with the cleaning brush 61, a relative speed between the first bristle material 61F and the second bristle material 63F at the contact portion of the removing brush 63 and the cleaning brush 61 is increased as compared with the case where the removing brush 63 is rotated in an opposite direction from the cleaning brush 61 and brought into contact with the cleaning brush 61. Therefore, a force with which the removing brush 63 flicks the first bristle material 61F is increased, and the toner on the cleaning brush 61 is easily removed.

In the cleaning device 60 of the present exemplary embodiment, the second power supply unit 66 applies the second voltage having a positive polarity and higher than the first voltage to the removing brush 63. Accordingly, an attraction force for electrostatically attracting the toner attracted to the cleaning brush 61 is generated in the removing brush 63, and the toner is easily removed from the cleaning brush 61 as compared with a case where a bias voltage equivalent to that of the cleaning brush 61 is applied to the removing brush 63. When a voltage is applied to the removing brush 63, the toner may be removed easily than in a case where the voltage is not applied.

In the cleaning device 60 of the present exemplary embodiment, since the toner on the cleaning brush 61 is removed by the removing brush 63 in this manner, it is possible to suppress accumulation of the toner on the cleaning brush 61, and it is possible to maintain cleaning ability of the cleaning brush 61 to clean the secondary transfer belt 36 for a long period of time.

Since the second bristle material 63F of the removing brush 63 enters and passes between the first bristle material 61F and the first bristle material 61F of the cleaning brush 61, it is possible to straighten the first bristle material 61F.

(Toner Removal by Removing Brush 63)

In the case of removing the toner attracted to the removing brush 63, for example, a voltage having the same polarity as the toner is applied to the removing brush 63 in a state where no image is being formed. Accordingly, the toner is electrostatically repelled, and the toner is separated from the removing brush 63. The toner removed from the removing brush 63 falls into the receiver 69 and is recovered.

Other Exemplary Embodiments

Although an exemplary embodiment of the present invention has been described above, the present invention is not limited to the above, and in addition to the above, it goes without saying that various modifications can be made within a range that does not deviate from the scope of the present invention.

Although the removing brush 63 of a columnar shape is rotated in a clockwise direction as the cleaning brush 61 in the above-described exemplary embodiment, a rotation direction of the removing brush 63 may be opposite to that of the cleaning brush 61.

Although the removing brush 63 is brought into contact with the cleaning brush 61 while being rotated in the above-described exemplary embodiment, the removing brush 63 may be rotated as necessary, and rotation of the removing brush 63 may be stopped when removal of the toner on the cleaning brush 61 is finished. If it is not necessary to rotate the removing brush 63, the second rotation driving device 68 may not be provided.

Although the removing brush 63 is rotated by the second rotation driving device 68 in the above-described exemplary embodiment, the removing brush 63 may be manually rotated.

Although plural second bristle materials 63F having the same length are provided on the shaft portion 63A in the removing brush 63 of the above-described exemplary embodiment, plural second bristle materials 63F having different lengths may be provided on the shaft portion 63A.

Although in the removing brush 63 of the above-described exemplary embodiment, the second bristle material 63F extends from the shaft portion 63A in a radial direction (a radially outward direction), the second bristle material 63F may extend so as to be inclined with respect to the radial direction (the radially outward direction). For example, the second bristle material 63F may be inclined toward a rotation direction side with respect to the radial direction (the radially outward direction), or may be inclined toward a side opposite to the rotation direction side.

Although the second voltage is applied to the removing brush 63 in the above-described exemplary embodiment, the second voltage may be applied as necessary, and when the toner on the cleaning brush 61 is removed only by bringing the removing brush 63 into contact with the cleaning brush 61, the second voltage may not be applied to the removing brush 63.

Although a shape of the removing brush 63 is a columnar shape in the above-described exemplary embodiment, the shape of the removing brush 63 is not limited to a columnar shape, and as long as the toner on the cleaning brush 61 can be removed, the removing brush 63 may be, for example, a structure in which plural bristle materials are provided on a long plate-shaped member.

Figure 5:
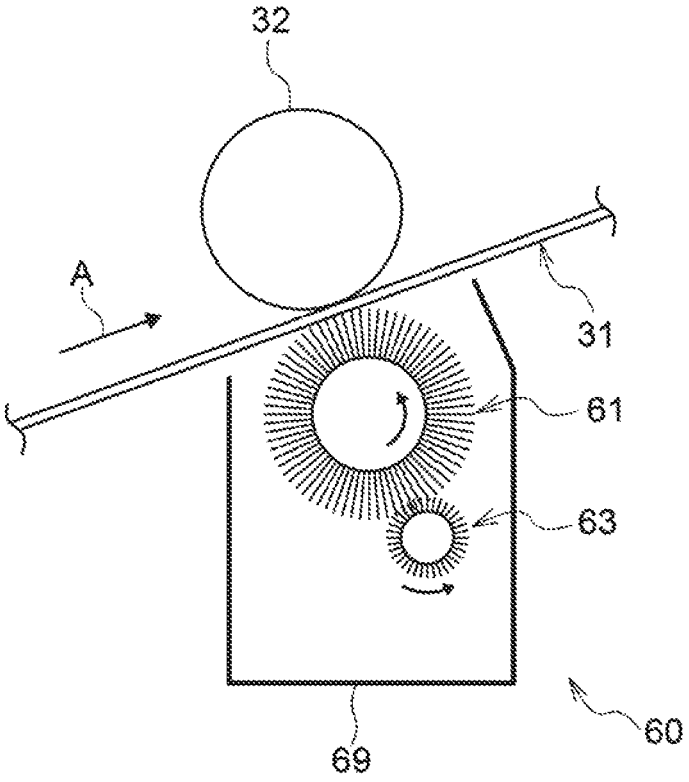
FIG. 5 is a schematic configuration diagram illustrating a main part of an image forming apparatus according to another exemplary embodiment.

Although the cleaning device 60 is used to clean the secondary transfer belt 36 in the above-described exemplary embodiment, the cleaning device 60 may also be used to clean the intermediate transfer belt 31. In this case, as illustrated in FIG. 5, the cleaning device 60 may be used instead of the cleaning device 35. Similarly to cleaning the secondary transfer belt 36, the cleaning device 60 may clean the toner adhering to the intermediate transfer belt 31.

In a case of an image forming apparatus without the secondary transfer belt 36 and having a configuration in which the recording medium P is nipped between the secondary transfer roller 34 and the intermediate transfer belt 31, the secondary transfer roller 34 serves as a toner transport body of the present invention. In this case, although not illustrated, the cleaning device 60 may be provided so as to face the secondary transfer roller 34, and thus the toner adhering to the secondary transfer roller 34 may be cleaned by the cleaning device 60.

Although an example in which the negatively charged toner is cleaned is described in the above-described exemplary embodiment, a positively charged toner may be cleaned by applying a negative voltage to the cleaning brush 61 and the removing brush 63.

When a negatively charged toner and a positively charged toner are mixed and adhere to the secondary transfer belt 36 (or the intermediate transfer belt 31), the cleaning device 60 that removes the negatively charged toner and the cleaning device 60 that removes the positively charged toner may be provided in series along the transport direction.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

REFERENCES SIGNS LIST

10 image forming apparatus
31 intermediate transfer belt (example of endless belt, and example of toner transport body serving as transfer member)
36 secondary transfer belt (example of toner transport body serving as transfer member)
P recording medium
61 cleaning brush (example of cleaning brush)
61B brush portion (example of first bristle material)
63 removing brush (example of removing brush)
63B brush portion (an example of second bristle material)
65 first power supply unit
66 second power supply unit
67 first rotation driving device (example of first rotation driving device)
68 second rotation driving device (example of second rotation driving device)

What is claimed is:

1. An image forming apparatus comprising:
a toner transport body comprising an endless belt configured to hold a toner image, or comprising a transfer member configured to transfer the toner image to a recording medium nipped between the endless belt and the transfer member;
a cleaning brush that has a plurality of first bristle materials,
wherein the cleaning brush is configured to rotate and to contact a surface of the toner transport body, and to clean a toner adhering to the surface of the toner transport body; and
a removing brush that has a plurality of second bristle materials configured to contact the first bristle material of the cleaning brush and to remove the toner adhering to the first bristle material,
wherein the first bristle materials of the cleaning brush and the second bristle materials of the removing brush are configured to move in directions opposite to each other at a contact portion of the removing brush and the cleaning brush.

2. The image forming apparatus according to claim 1, wherein the removing brush is formed in a columnar shape, and an outer peripheral portion of the removing brush is configured to contact the cleaning brush.

3. The image forming apparatus according to claim 2, further comprising:
a first rotation driving device configured to rotate the removing brush.

4. The image forming apparatus according to claim 3, further comprising:
a second rotation driving device configured to rotate the cleaning brush.

5. The image forming apparatus according to claim 1, wherein a bias voltage having a polarity opposite to a polarity of the toner is applied to the cleaning brush and the removing brush, and
wherein a bias voltage larger than the bias voltage applied to the cleaning brush is applied to the removing brush.

6. The image forming apparatus according to claim 2, wherein a bias voltage having a polarity opposite to a polarity of the toner is applied to the cleaning brush and the removing brush, and
wherein a bias voltage larger than the bias voltage applied to the cleaning brush is applied to the removing brush.

7. The image forming apparatus according to claim 3, wherein a bias voltage having a polarity opposite to a polarity of the toner is applied to the cleaning brush and the removing brush, and
wherein a bias voltage larger than the bias voltage applied to the cleaning brush is applied to the removing brush.

8. The image forming apparatus according to claim 4, wherein a bias voltage having a polarity opposite to a polarity of the toner is applied to the cleaning brush and the removing brush, and
wherein a bias voltage larger than the bias voltage applied to the cleaning brush is applied to the removing brush.

* * * * *